United States Patent [19]

Dussart

[11] 4,150,712

[45] Apr. 24, 1979

[54] CONTINUOUS-CASTING MOULD PROVIDED WITH AN ELECTROMAGNETIC STIRRING DEVICE

[75] Inventor: Bernard Dussart, Haulchin, France

[73] Assignee: Union Siderurgique du Nord et de l'Est de la France, Paris, France

[21] Appl. No.: 882,045

[22] Filed: Feb. 28, 1978

[30] Foreign Application Priority Data

Mar. 3, 1977 [FR] France ..... 77 06293

[51] Int. Cl.[2] ..... B22D 27/02; B22D 11/10

[52] U.S. Cl. ..... 164/147; 164/443; 164/250

[58] Field of Search ..... 164/48, 49, 146, 147, 164/250; 266/233, 234

[56] References Cited

U.S. PATENT DOCUMENTS

| | | | |
|---|---|---|---|
| 4,009,749 | 3/1977 | Alberny | 164/147 |
| 4,040,467 | 8/1977 | Alberny et al. | 164/49 |
| 4,042,008 | 8/1977 | Alberny et al. | 164/147 |
| 4,059,142 | 11/1977 | Alberny et al. | 164/49 |
| 4,067,378 | 1/1978 | Alberny | 164/49 |

*Primary Examiner*—Othell M. Simpson
*Assistant Examiner*—K. Y. Lin
*Attorney, Agent, or Firm*—Burns, Doane, Swecker & Mathis

[57] ABSTRACT

The mould comprises a copper mould at least partly surrounded by a cooling box in which a cooling fluid flows. The cooling box comprises a first chamber defined by the copper wall of the mould and by a parallel front wall of the box. This front wall includes magnetic poles which are part of an electromagnetic induction stirring device for the metal cast in the mould. The first chamber is connected to a first cooling circuit. The box also has a second chamber in which the coils and cores of the electromagnetic induction stirring device are disposed.

10 Claims, 1 Drawing Figure

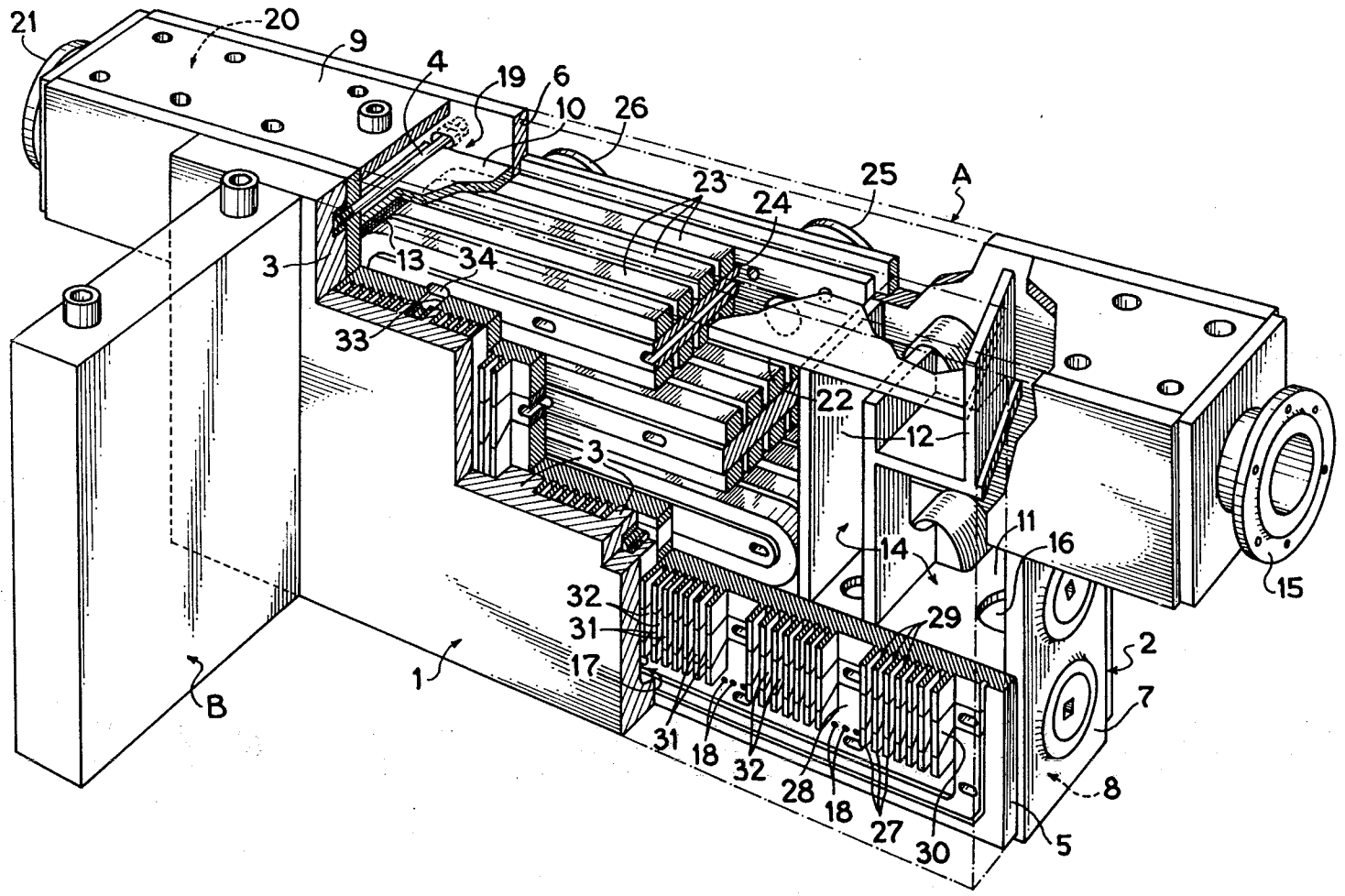
A
B
1
2
3
4
5
6
7
8
9
10
11
12
13
14
15
16
17
18
19
20
21
22
23
24
25
26
27
28
29
30
31
32
33
34

CONTINUOUS-CASTING MOULD PROVIDED WITH AN ELECTROMAGNETIC STIRRING DEVICE

The present invention relates to continuouscasting installations and in particular moulds employed in said installations.

U.S. Pat. No. 4,103,703 discloses a continuous casting installation for products of relatively small size, this installation being provided with electromagnetic stirring of agitating means employing an induction current the frequency of which is lower than 10 Hertz. The advantages of this type of stirring are explained in detail in said patent and concerns in particular the metallurgical quality of the product obtained and the simplicity and output of the installation.

In the case of slab blooms, the essential metallurgical interest of the stirring is to achieve an artificial effervescence which brings away from the solidification front by a localized turbulence the inclusions and porosities which adhere to the basaltic skin.

An object of the invention is to provide a continuous-casting mould for casting slab blooms or like products which permits carrying out the electromagnetic stirring process with a satisfactory energy efficiency and a prolonged life.

According to the invention, there is provided a continuous-casting mould of the type comprising a copper mould surrounded at least partly by a cooling box in which a cooling fluid flows, wherein the cooling box comprises a first chamber defined by the wall of copper of the mould and by a parallel front wall including magnetic poles which are part of an induction stirring device, said first chamber being connected to a first cooling circuit, and a second chamber in which there are disposed the coils and the cores of the electromagnetic induction device.

According to other features:

the second chamber is connected to a second cooling circuit;

the first chamber of the box is defined by the copper wall of the mould and by a parallel front wall formed at least in part by stainless steel, this second wall having ribs and grooves in which the liquid of the first cooling circuit flows;

said front wall of the box comprises magnetic poles which are part of the stirring device and made from mild steel and embedded in the stainless steel part of said wall;

the box comprises a primary mould-cooling fluid inlet, an inlet manifold extending practically throughout the length of the mould and connected to the inlet pipe and to the first chamber of the box, said first chamber being connected through an outlet manifold to an outlet pipe of the primary cooling liquid;

the copper wall of the mould has a thickness reduced to its useful thickness, that is to say to the exclusion of the initial grooves, and comprises a plurality of studs or posts projecting from the face thereof facing the cooling chamber and adapted to bear against the adjacent wall of the box, said studs receiving fixing tie rods of magnetic steel which preferably serve as a support for the cores of the stirring device.

The invention will be described in detail hereinafter with reference to the accompanying drawing which is given solely by way of example and in which the single FIGURE is a perspective view of a part of a mould according to the invention.

The FIGURE shows a part of a continuous-casting mould defining a casting section of rectangular shape. The mould comprises four elements, two longitudinal elements, such as A, and two transverse elements, such as B, the position of which latter is adjustable to determine the dimensions of the cast product. The longitudinal elements are provided with electromagnetic stirring or agitating devices and are therefore improved in accordance with the invention. Only one thereof will be described hereinafter, since the other element comprises the same arrangements. The two transverse elements are of conventional design and therefore need not be described here.

The illustrated mould element A mainly comprises a copper plate 1 which may be planar or curved and is fixed to a cooling box 2.

The copper plate has a reduced thickness of the order of 40 mm for example in the major part of its area and includes on the face thereof adjacent the cooling box studs or posts 3 which project from this face and have a thickness of the order of 25 mm for example. These studs act as anchoring means for tie rods 4 which are of magnetic steel and are tightened against the rear wall of the box.

The cooling box proper has a generally parallel-sided shape and consequently mainly comprises a front wall 5, a rear wall 6, lateral end walls 7, a bottom end wall 8 and a top end wall 9. It is divided by longitudinal partition walls 10, 11 and transverse partition walls 12, 13 into five parts namely:

an inlet chamber 14 connected to an inlet pipe 15 for primary mould-cooling fluid;

an inlet manifold 16 located in the lower part of the box and communicating with the inlet chamber 14 and with a cooling chamber 17 defined between the front wall 5 of the box and the copper plate 1; this communication is by way of orifices 18 formed in the front wall 5;

an outlet manifold 19 located in the upper part of the box and communicating with the chamber 17 by way of orifices (not shown) similar to the orifices 18;

an outlet chamber 20 connected to the manifold 19 and to an outlet pipe 21 for discharging the primary cooling fluid;

a central compartment 22 which is separated in a sealed manner from the adjacent compartments and from the chamber 17 defined between the copper plate and the front wall of the box; this central compartment constitutes a second chamber in which are disposed the coils 23 and the cores 24 of the electromagnetic stirring or agitating device; this chamber is connected by pipes 25, 26 to a secondary cooling circuit independent from the aforementioned primary cooling circuit.

The front wall 5 of the cooling box is made mainly from stainless steel and has, on the face thereof confronting the copper plate 1, groups of vertical ribs 27 separated by wider gaps 28 corresponding to the studs 3. The ribs 27 are in contact by their end faces with the adjacent face of the copper plate 1. They define therebetween grooves 29 for the passage of the cooling fluid. According to a particularly advantageous and essential feature of the invention, pole pieces 30 of mild steel are embedded in the stainless steel wall of the box, these pole pieces also having ribs 31 and grooves 32 so as to ensure the continuity of the passages for the cooling fluid. These pole pieces are in contact with the cores of the stirring device and with the copper plate 1 of the mould.

Note that the orifices 33 and 34, provided respectively in the front wall of the box and in the cores of the stirring device and adapted to allow the passage of the tie rods 4, have an oblong section the major axis of which is parallel to the longitudinal direction of the mould element so as to be capable of accommodating the displacements of these tie rods produced by expansions of the copper plate.

The electromagnetic stirring device adapted to generate a sliding field in the metal cast in the mould, is supplied with the inducing current at a frequency lower than 10 Hertz, for example 3 Hertz so as to obtain a speed of synchronism of the order of 1.5 meter per second which is sufficient to drive the metal at a speed lower than 1 meter per second. In order to facilitate the closing of the magnetic fluxes and avoid a heating of the rear wall 6 of the box, the return circuits of the poles are laminated structures. The metal travels vertically along the walls of the mould.

It is unnecessary to repeat here the advantages from the metallurgical point of view of this stirring in a continuous-casting mould and merely the particular advantages resulting from the construction of this mould will be underlined.

Owing to the grooves formed in the front wall of the cooling box, and to the corresponding reduction in the thickness of the copper plate resulting therefrom, the efficiency of the stirring device is substantially improved and the heating of the copper plate under the effect of eddy currents is considerably reduced, which reduces the wear of the mould.

These cooling grooves also ensure the laminated structure and the cooling of the pole pieces inserted in the stainless steel wall in contact with the copper plate. These pole pieces are in immediate contact with the copper mould, which contributes to the improvement of the energy efficiency.

Further, the cooling box has been arranged to cool the mould and the stirring device with two different circuits, the secondary circuit being regulated to have a much lower flow, which permits reducing in this respect the operating costs of the installation. The overall size of the assembly remains comparable to that of a conventional mould and the stirring device can therefore be incorporated in the installation without any profound, costly adaptation of the surrounding part of the installation.

I claim:

1. A continuous-casting mould structure comprising copper walls defining a copper mould and walls defining a cooling box which at least partly surrounds the mould, the cooling box comprising a first chamber and second chamber, the first chamber being defined by one of said walls of the mould and by a substantially parallel front wall of the box which front wall is made at least in part from stainless steel, said first chamber being intermediate the second chamber and the mold and an electromagnetic induction stirring device mounted inside said second chamber and comprising cores, field-producing coils mounted on the cores, and the induction stirring device further comprising poles of magnetic steel in contact with the cores, the poles being embedded in said front wall and extending substantially throughout the width of the first chamber and extending throughout the thickness of said front wall and having portions which extend through said first chamber into contacting relationship with one of said copper walls.

2. A mould as claimed in claim 1, comprising a second cooling fluid circuit connected to the said second chamber, said first chamber being sealed from said second chamber.

3. A continuous-casting mould structure comprising copper walls defining a copper mould and walls defining a cooling box which at least partly surrounds the mould, the cooling box comprising a first chamber and second chamber, the first chamber being defined by one of said walls of the mould and by a substantially parallel front wall of the box which front wall is made at least in part from stainless steel, said first chamber being intermediate the second chamber and the mold and an electromagnetic induction stirring device mounted inside said second chamber and comprising cores, field-producing coils mounted on the cores, and the induction stirring device further comprising poles of magnetic steel in contact with the cores, the poles being embedded in said front wall and extending substantially throughout the width of the first chamber and extending throughout the thickness of said front wall and having portions which extend through said first chamber into contacting relationship with one of said copper walls, said first chamber containing means defining ribs and grooves through which grooves the cooling fluid of the first chamber flows, said ribs being provided solely on said front wall to the exclusion of one of said copper walls and engaging one of said copper walls whereby, for a given thickness of one of said copper walls, the poles are brought nearer to the molten metal in the mould and the stirring power is increased.

4. A continuous-casting mould structure as claimed in claim 3, wherein ribs and grooves are also provided in said portions of said poles to allow the cooling fluid to flow through the grooves of said portions of said poles for cooling said poles.

5. A mould as claimed in claim 1, wherein the copper mould has two substantially parallel longitudinal walls and two substantially parallel transverse walls and each of the two longitudinal walls of the mould is provided with one of said cooling boxes in combination therewith.

6. A mould as claimed in claim 1, wherein the cooling box comprises a primary mould-cooling fluid inlet pipe, an inlet manifold extending throughout the length of the mould and connected to the inlet pipe and to said first chamber of the box, an outlet manifold and a primary cooling fluid outlet pipe connected to the first chamber through the outlet manifold.

7. A mould as claimed in claim 6, comprising a series or orifices formed in said front wall of the box and putting the first chamber in communication with the inlet and outlet manifolds.

8. A mould as claimed in claim 3, wherein one of said copper walls of the mould is of reduced thickness in the major part of its area and comprises a plurality of projections which are located between said portions of the poles and project from a face of one of said copper walls confronting said front wall and bear against said front wall and are provided solely for anchoring purposes, fixing tie rods of magnetic steel being anchored in said projections.

9. A mould as claimed in claim 8, wherein the tie rods serve to support the cores of the stirring device.

10. A mould as claimed in claim 8, comprising means defining orifices through which the tie rods pass, and which have an oblong section the major axis of which shape is parallel to a longitudinal direction of the cross-section of the mould.

* * * * *